US007966962B1

(12) United States Patent
Fox

(10) Patent No.: US 7,966,962 B1
(45) Date of Patent: Jun. 28, 2011

(54) BOARDING AID FOR INFLATABLE DINGHY

(76) Inventor: Stephen I. Fox, Nyack, NY (US)

( * ) Notice: Subject to any disclaimer, the term of this patent is extended or adjusted under 35 U.S.C. 154(b) by 0 days.

(21) Appl. No.: 12/814,055

(22) Filed: Jun. 11, 2010

Related U.S. Application Data

(63) Continuation-in-part of application No. 12/409,558, filed on Mar. 24, 2009, now abandoned.

(60) Provisional application No. 61/292,286, filed on Jan. 5, 2010.

(51) Int. Cl.
*B63B 17/00* (2006.01)

(52) U.S. Cl. ..... 114/362

(58) Field of Classification Search ..... 114/361, 114/362, 343, 364
See application file for complete search history.

(56) References Cited

U.S. PATENT DOCUMENTS

| | | | |
|---|---|---|---|
| 468,960 | A | 2/1892 | Vondersaar |
| 4,074,379 | A | 2/1978 | Grossman et al. |
| 4,807,556 | A | 2/1989 | Hillier |
| 5,005,255 | A | 4/1991 | Pare et al. |
| 5,269,044 | A | 12/1993 | Marion |
| 5,662,060 | A | 9/1997 | Lemke |
| 5,788,133 | A | 8/1998 | Mareno |
| 6,796,863 | B1 | 9/2004 | Oathout |
| 6,945,188 | B2 | 9/2005 | Eck et al. |
| 7,240,634 | B1 | 7/2007 | Hoge, Jr. |
| 2007/0056499 | A1 | 3/2007 | Palmer |
| 2007/0068443 | A1 | 3/2007 | Zochert |
| 2007/0144425 | A1 | 6/2007 | Buckley |

OTHER PUBLICATIONS

Page from www.defender.com (admitted to be prior art).
Page from www.seaeagle.com, Sea Eagle Casting Bar for Foldcat, disclosure published as early as Oct. 11, 2007.

*Primary Examiner* — Ed Swinehart
(74) *Attorney, Agent, or Firm* — Arthur Jocob

(57) ABSTRACT

A boarding aid assists a person in embarking on and disembarking from a deployed dinghy having inflatable pontoon sides with inboard side portions providing opposite inboard side locations. A handgrip bar is supported by a support structure coupled with the dinghy at the opposite inboard side locations, at least substantially midway between the bottom and the gunwale of each pontoon side of the dinghy. When the support structure is in an erect position, the handgrip bar is placed across the beam of the dinghy, with the handgrip bar spaced from the bow and the stern of the dinghy, at an elevated position placing handgrips directly above gunwales of the pontoon sides, rendering a handgrip accessible for ready grasping by a person remaining essentially erect as the person steps aboard or leaves the dinghy. The support structure is selectively removable for stowing apart from the dinghy. In some embodiments, selective pivotal movement of the support structure away from an erect position enables the support structure to be collapsed into a position nested between the pontoon sides for compact stowing with the dinghy.

28 Claims, 13 Drawing Sheets

BOARDING AID FOR INFLATABLE DINGHY

This application is a continuation-in-part of application Ser. No. 12/409,558, filed Mar. 24, 2009, now abandoned, and claims the benefit of provisional application Ser. No. 61/292,286, filed Jan. 5, 2010.

The present invention relates generally to inflatable dinghies and pertains, more specifically, to a boarding aid for assisting a person in embarking on or disembarking from a deployed inflatable dinghy.

Boating has grown in popularity and currently is engaged in by a very large number of people throughout the world. In particular, boaters enjoy visiting a variety of ports, many of which provide mooring facilities that require the boater to employ some other form of conveyance when traveling from a moored boat to shore, and subsequently back the boat. By far, the most ubiquitous conveyance for that use is an inflatable dinghy carried or towed by the boat and deployed as needed.

While, in general, inflatable dinghies are convenient to use and provide a high degree of safety, boarding an inflatable dinghy, as well as exiting from the dinghy, can present a challenge, especially to children and older passengers who may not be as sure-footed and confident as other passengers. Inflatable dinghies are somewhat skittish on the water, and when tied to a fixed dock are at various elevations with respect to the dock, especially in tidal waters. Accordingly, there is a need for an aid which can be made available readily to assist a person during embarking on and debarking from an inflatable dinghy, especially when tied to a dock, and is relatively unobtrusive during use of the dinghy, as well as when the dinghy is stowed aboard a boat, ready for deployment, as required.

The present invention provides such a boarding aid and, as such, attains several objects and advantages, some of which are summarized as follows: Provides a handgrip having extended dimensions and being placed in an inflatable dingy, located and oriented for convenient grasping to assist a person in boarding or leaving the dinghy; enables a passenger to embark upon or debark from an inflatable dinghy while maintaining a confident and sure-footed posture for reducing apprehension and increasing safety, especially where the dinghy is at various elevations with respect to a dock in tidal waters; maintains a high degree safety while a passenger boards or leaves an inflatable dinghy; allows quick and convenient attachment of a handgrip to an inflatable dinghy upon deployment of the dinghy, while enabling ease of detachment upon stowing of the dinghy; is readily collapsible for placement in an unobtrusive position when not in use; is unobtrusive during use of the dinghy and compact for ready storage when the dinghy is stowed; provides a highly stable and reliable attachment to an inflatable dinghy while protecting the dinghy from excessive stresses and concomitant damage at various points of attachment; adjusts readily to relevant dimensions of a particular inflatable dinghy for universal use; provides a relatively inexpensive construction, readily fitted to current inflatable dinghies of various dimensions for encouraging widespread adoption and use; is installed readily on an existing inflatable dinghy without requiring special tools or special skills; promotes boating safety and convenience for an enhanced boating experience over a wider audience of boaters; enables a reliable and effective coupling of a boarding aid to an inflatable dinghy, without adversely affecting existing component parts of the dinghy; provides a rugged construction, resistant to wear and corrosion, for exemplary performance over an extended service life.

The above objects and advantages, as well as further objects and advantages, are attained by the present invention which may be described briefly as a boarding aid for assisting a person in embarking on and disembarking from a dinghy having inflatable pontoon sides spaced apart in lateral directions by a predetermined lateral distance and having inboard side portions providing opposite confronting inboard side locations spaced apart laterally by a predetermined inboard side distance, the pontoon sides extending in forward and aft directions between a bow and a stern, a floor extending laterally between the pontoon sides and longitudinally in forward and aft directions between the bow and the stern, and a transom extending between the pontoon sides adjacent the stern, each pontoon side extending altitudinally upward from a bottom to a gunwale located at a predetermined height above the floor, the boarding aid comprising: a handgrip bar having a length extending between opposite bar portions; a support structure having a first support portion for juxtaposition with the inboard side locations of both pontoon sides, and a second support portion spaced from the first support portion along a longitudinal direction, the support structure being joined with the handgrip bar adjacent the second support portion of the support structure such that the handgrip bar extends laterally with respect to the longitudinal direction of the support structure along a lateral distance substantially corresponding to the predetermined lateral distance between the pontoon sides; and a coupling arrangement for coupling the first support portion of the support structure with the dinghy at a corresponding coupling location spaced away from the bow in an aft direction and spaced away from the stern in a forward direction, the coupling arrangement including at least one pair of couplings, each coupling of the one pair of couplings including support members spaced apart in a forward and aft direction by a support distance, at least one of the support members being configured and dimensioned for affixation to a corresponding pontoon side, at an affixation position on the inboard side location of the corresponding pontoon side, with the affixation position placed altitudinally at least substantially midway between the botto, and the gunwale of the corresponding pontoon side, and another of the support members being configured and dimensioned for affixation to the dinghy at the corresponding coupling location; the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions and placed at an elevated position located a substantial altitudinal distance directly above the gunwales, a forward distance from the transom, and an aft distance from the bow, so as to be accessible for ready grasping by a person remaining essentially erect as the person steps aboard or debarks from the dinghy.

The invention will be understood more fully, while still further objects and advantages will become apparent, in the following detailed description of preferred embodiments of the invention illustrated in the accompanying drawing, in which.

Figure 1:
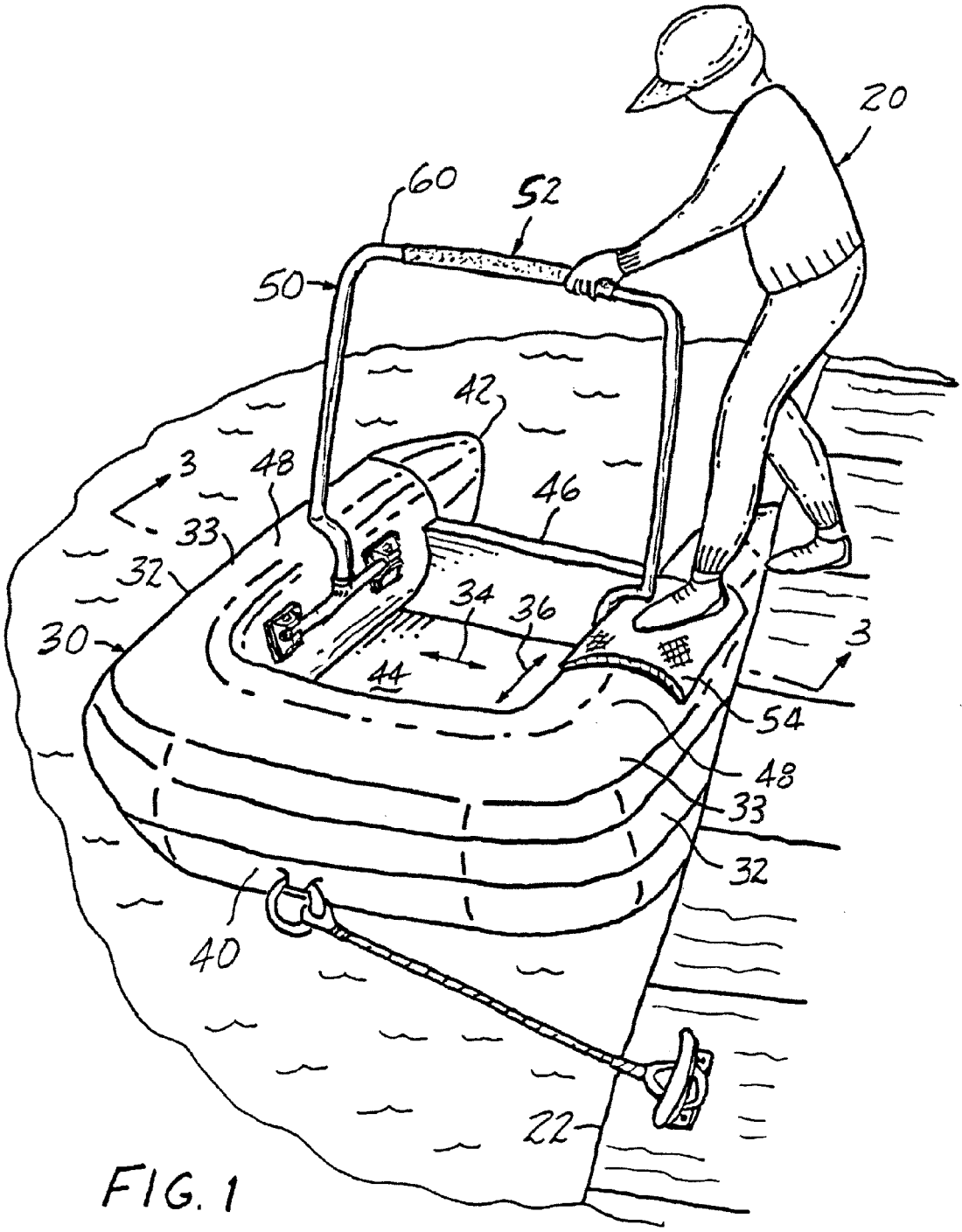
FIGS. 1 and 2 are pictorial views showing a boarding aid in use in connection with boarding an inflatable dinghy.
Figure 2:
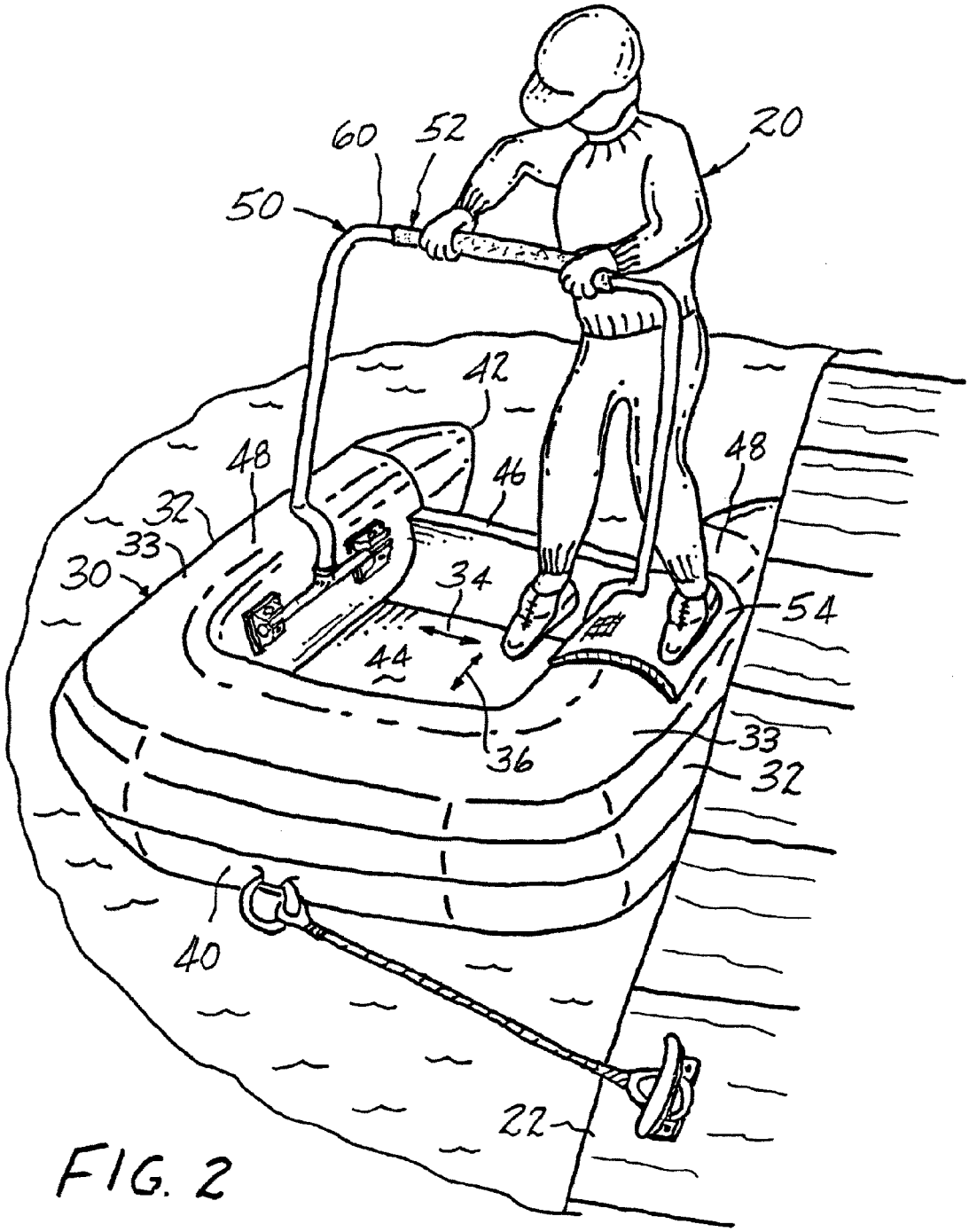
Figure 3:
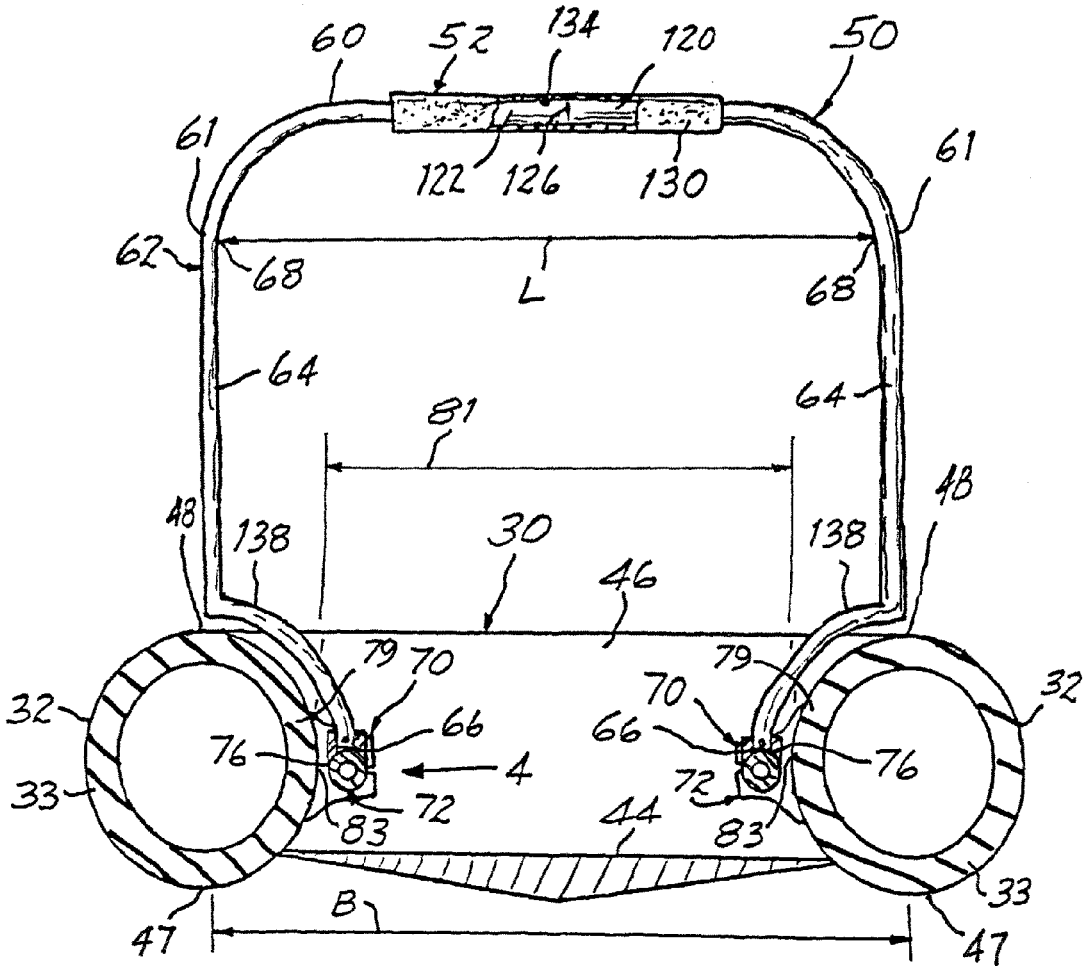
FIG. 3 is a partially diagrammatic, enlarged lateral cross-sectional view taken along line 3-3 of FIG. 1.
Figure 4:
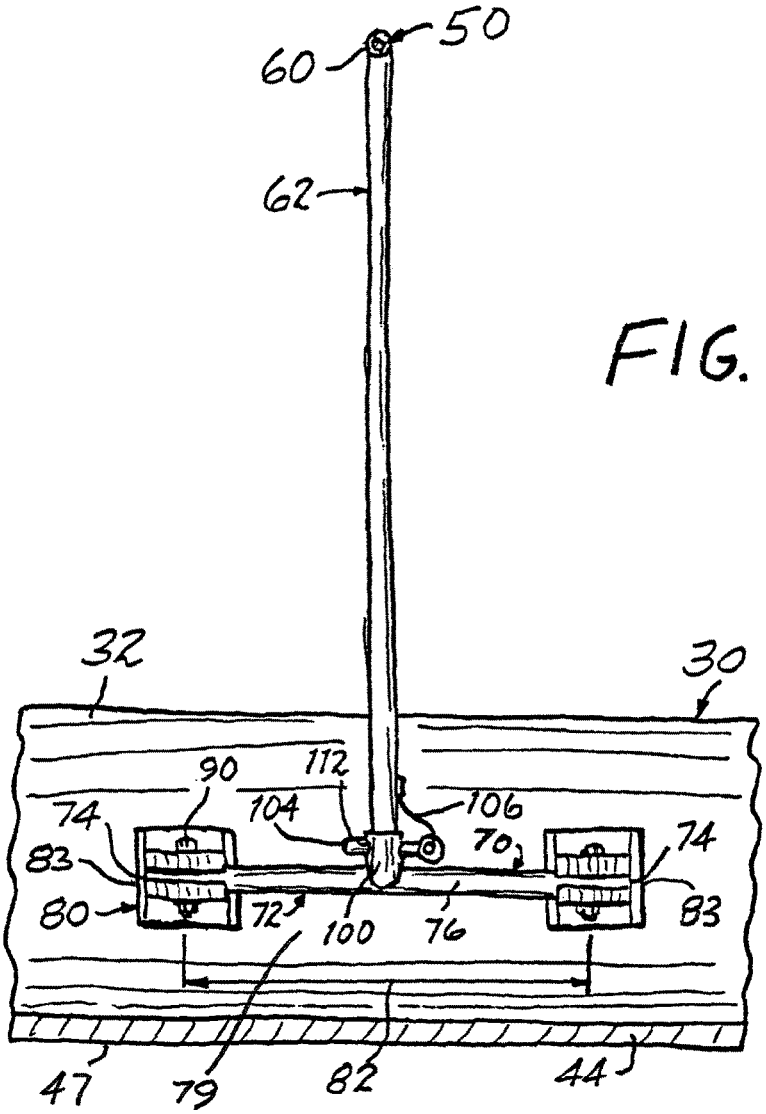
FIG. 4 is an enlarged fragmentary elevational view taken in the direction of arrow 4 in FIG. 3.
Figure 5:
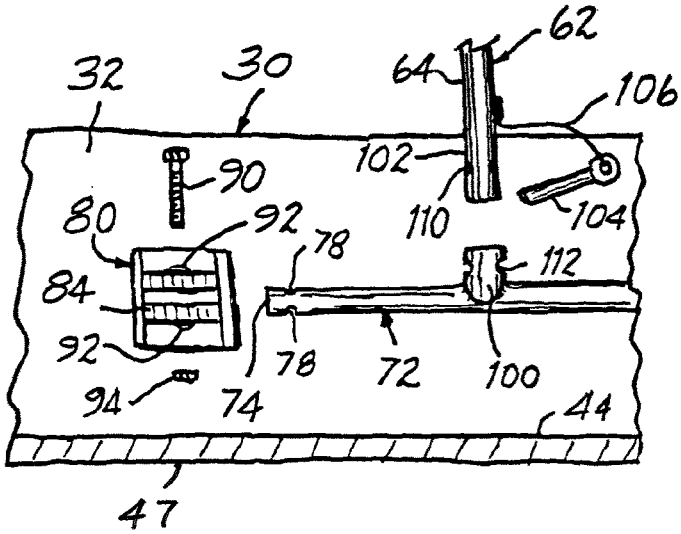
FIG. 5 is a fragmentary elevational view of a portion of FIG. 4, exploded to show component parts in another position.

Referring now to the drawing, and especially to FIGS. 1 and 2 thereof, a person is shown at 20 stepping from a dock 22 to board and be seated in an inflatable dinghy 30 tied to the dock 22. Inflatable dinghy 30 is of conventional construction, having inflated pontoon sides 32 constructed in the form of tubular walls 33 and spaced apart in lateral directions 34, the pontoon sides 32 extending in forward and aft directions 36 between a bow 40 and a stern 42. A floor 44 extends laterally between the pontoon sides 32 and longitudinally in the forward and aft directions between the bow 40 and the stern 42. A transom 46 extends laterally between the pontoon sides 32, adjacent the stern 42, and the pontoon sides 32 each extend altitudinally upward from a bottom 47 to a gunwale 48.

A boarding aid constructed in accordance with the present invention is shown at 50 and is installed in dinghy 30 to provide a handgrip 52 at an elevated position located a substantial altitudinal distance above the gunwales 48 and oriented in alignment with lateral directions 34 so as to extend to directly above the gunwales 48 and be placed for ready grasping by the person 20 while the person 20 remains in an essentially erect posture as the person steps aboard the dinghy 30, thereby enabling a sure-footed stance and promoting confidence during boarding, and during leaving dinghy 30. That is, as the person 20 steps from the dock 22 to the dinghy 30, as seen in FIG. 1, handgrip 52 is available for ready grasping while the person 20 has a sure-footed purchase on the dock 22 and on the dinghy 30. Then, as the person 20 continues boarding and steps down into dinghy 30, as illustrated in FIG. 2, handgrip 52 still is available for grasping, now with two hands spread apart in lateral directions, to maintain confidence, stability and safety.

Throughout the boarding process, handgrip 52 is available to enable the person 20 to remain in the essentially erect posture, for a sure-footed stance providing confidence and safety. This is particularly true where the dinghy 30 is tied to a fixed dock 22 in tidal waters where the difference in elevation between the dinghy 30 and the dock 22 may be extensive and may vary with the tide. Further, the handgrip 52 is placed at a forward distance from the transom 46 and at an aft distance from the bow 40 so as to maintain stability as the person 20 steps aboard and is seated within the dinghy 30, or rises to leave the dinghy 30, the forward distance and the aft distance preferably placing the handgrip 52 at an amidships location, that is, essentially midway between the stern 42 and the bow 40, spaced from both the bow 40 and the transom 46, to facilitate appropriate placement of the person 20 within the dinghy 30 upon boarding and to ease exit from the dinghy 30 upon leaving. Preferably, a boarding mat 54 of a skid-resistant material is draped over the gunwale 48 which is adjacent dock 22, as shown, in order to enhance a sure-footed purchase as the person 20 steps upon the pontoon side 32.

Turning now to FIGS. 3 through 8, as well as to FIGS. 1 and 2, pontoon sides 32 are spaced apart by a predetermined lateral distance to provide dinghy 30 with a given beam B, and handgrip 52 includes a handgrip bar 60 having a length L between opposite bar portions 61 substantially corresponding to the beam B of dinghy 30 so that, together with the lateral orientation of handgrip bar 60, the handgrip bar 60 is rendered readily accessible for grasping by the person 20, as illustrated in FIGS. 1 and 2. To that end, handgrip bar 60 is supported by a support structure 62, here shown in the form of a pair of standards 64. Upon erection of the support structure 62, with each standard 64 depending from a corresponding bar portion 61, the support structure 62 and the handgrip bar 60 establish a generally inverted U-shaped configuration comprised of the laterally extending handgrip bar 60 and the depending standards 64, with the support structure 62 having a prescribed length extending along a longitudinal direction between a first support portion shown in the form of a first end 66 juxtaposed with the pontoon sides 32, adjacent the floor 44, and a second support portion 68 juxtaposed with the handgrip bar 60. The preferred, inverted U-shaped configuration places the standards 64 in juxtaposition with corresponding pontoon sides 32, spaced apart in lateral directions so as to enable unobstructed movement of a person 20 within the dinghy 30 during boarding and leaving the dinghy 30, as well as during traveling in the dinghy 30.

A coupling arrangement couples the first end 66 of the support structure 62 with the dinghy 30 and includes a pair of couplings 70, each coupling 70 being configured and dimensioned for affixation to a corresponding pontoon side 32. Thus, each coupling 70 includes a support rod 72 having a rod length between opposite rod ends 74 and a first attachment element at each rod end 72, the support rod 72 preferably being in the form of a substantially rigid tubular member 76 drilled adjacent the rod ends 74 to establish a first attachment element in the form of transverse holes 78. Each coupling 70 further includes a pair of support members 80, each support member 80 being configured and dimensioned for affixation to a corresponding pontoon side 32, with the pair of support members 80 spaced apart in forward and aft directions by a support distance 82. Thus, each support member 80 includes a base 82, preferably constructed of an elastomeric material, such as rubber, for conforming to the cross-sectional configuration of the corresponding pontoon side 32. The support members 80 are affixed to the pontoon sides 32, as by an adhesive placed along base 82, so as to be permanently attached to the dinghy 30, at laterally opposite side affixation positions in the form of confronting inboard affixation locations 83 provided along side portions in the form of inboard side portions 79 of the walls 33 of pontoon sides 32. Inboard affixation locations 83 are spaced apart laterally by a predetermined inboard distance 81 and each inboard affixation location 83 is spaced altitudinally from the floor 44 and from the corresponding gunwale 48 to place each support member 80 substantially midway between the bottom 47 and the gunwale 48 where the structure of the wall 33 of the pontoon side 32 best accommodates the affixation of a support member 80, as will be described below.

Figure 6:
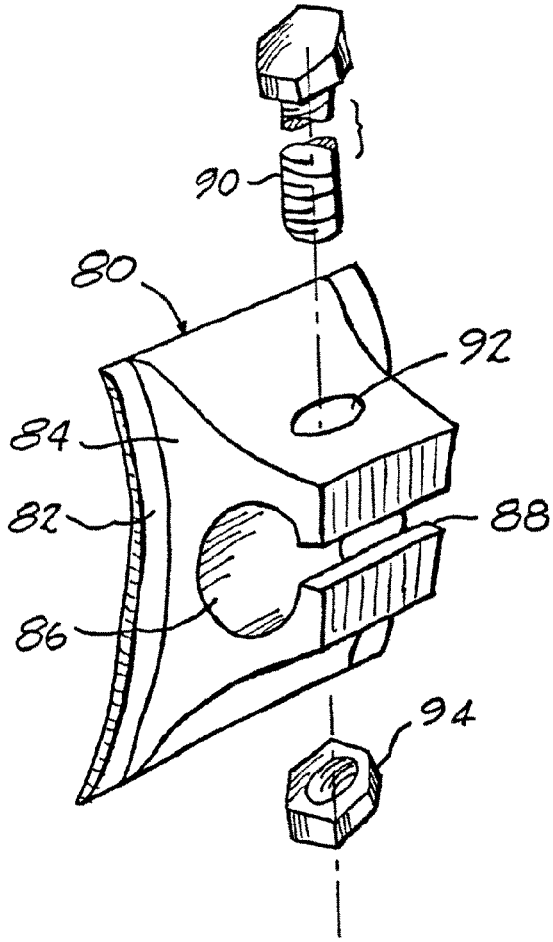
FIG. 6 is a pictorial perspective view of component parts of the boarding aid.

As best seen in FIG. 6, support members 80 each include a post 84, preferably constructed integral with base 82, as by molding post 84 unitary with base 82. A bore 86 passes through post 84, and post 84 is split, as shown at 88. Bores 86 are substantially complementary to rod ends 74, and rod ends 74 are inserted into corresponding bores 86 to mount each support rod 72 to a corresponding pontoon side 32. A bolt 90 is inserted through apertures 92 in post 84, and through aligned drilled holes 78 in each rod end 74, and a nut 94 is threaded onto each bolt 90 to secure each support rod 72 in place, with each split post 84 drawn into a tight fit with a corresponding rod end 74.

Each support rod 72 carries a coupling member at a coupling location intermediate the rod ends 74, the coupling member being shown in the form of a socket 100 permanently secured to support rod 72, as by welding. Each standard 64 follows a curved configuration directed inwardly in an inboard direction adjacent the first end 66 of support structure 62 and includes a further coupling member in the form of a plug 102 having a configuration complementary to socket 100. Upon insertion of each plug 102 into a corresponding socket 100, support structure 62 is coupled with support rods 72 and boarding aid 50 is erected in dinghy 30, with handgrip 52 accessible for ready grasping by person 20. Each plug 102 is secured in place within a socket 100 by passing a locking pin 104 through respective registered apertures 110 and 112 in plugs 102 and sockets 100. Each locking pin 104 is tethered, as by tether 106, to a standard 64 for convenience as well as for safety.

With the support structure 62 coupled to support rods 72 at the coupling location provided by the position of the sockets 100 on the support rods 72, and the location of the support rods 72 on the pontoon sides 32, which places the handgrip 52 at the elevated position essentially amidships, stability of the dinghy 30 is assured during the embarking and disembarking of a passenger, as exemplified by person 20. In addition, should the dinghy 30 be provided with a motor (not shown) attached to the transom 46, spacing of the boarding aid 50 well forward of the transom 46 avoids obstruction by the motor during boarding and exiting the dinghy 30, and allows a driver to remain in place adjacent the motor while other passengers can embark and debark freely. Moreover, the placement of sockets 100 intermediate the rod ends 74, with the rod ends 74 secured to a corresponding pontoon side 32 by support members 80 spaced apart in forward and aft directions by support distance 82, further promotes stability of the dinghy 30 during boarding and exiting the dinghy 30. Additionally, with respect to the pair of support members 80 which support a support rod 72, the spacing of one support member 80 of the pair, spaced from the amidships location in a forward direction while the other support member 80 of the pair is spaced from the amidships location in an aft direction, further enhances stability of the dinghy 30 as a person 20 boards and leaves the dinghy 30. At the same time, the coupling arrangement which includes support rods 72 secured to spaced apart support members 80 distributes the load associated with supporting the boarding or exiting person 20, thus reducing the stress upon the pontoon sides 32 at each juncture between a support member 80 and wall 33 of a pontoon side 32, thereby better preserving the integrity of the wall 33 of pontoon side 32. The affixation of each support member 80 at an inboard affixation location 83 placed on a side portion 79 of wall 33 altitudinally substantially midway between the bottom 47 and a the gunwale 48 assures that the load imposed upon wall 33 of a pontoon side 32 at each support member 80 will be accommodated without deleterious buckling or other unwanted movement of the material of wall 33 of each pontoon side 32. In the preferred construction, support structure 62 is constructed of a corrosion-resistant metal tubing such as, for example, one-inch diameter stainless steel tubing. In order to place handgrip 52 at the desired elevational position, the prescribed length between first end 66 and support portion 68 of support structure 62 is such that the handgrip bar 60 is placed at a substantial altitudinal distance above the gunwales 48, a typical altitudinal distance being about thirty inches.

When it is desired to stow the dinghy 30, support structure 62 is easily removed from the dinghy 30 by merely withdrawing locking pins 104 and pulling plugs 102 from corresponding sockets 100, thereby releasing support structure 62, and handgrip 52, from dinghy 30 for compact storage apart from dinghy 30. Should it become necessary to release support rods 72 from dinghy 30, as for maintenance or cleaning, it becomes a simple matter to remove bolts 90 and slide support rod ends 74 from bores 86.

Figure 7:
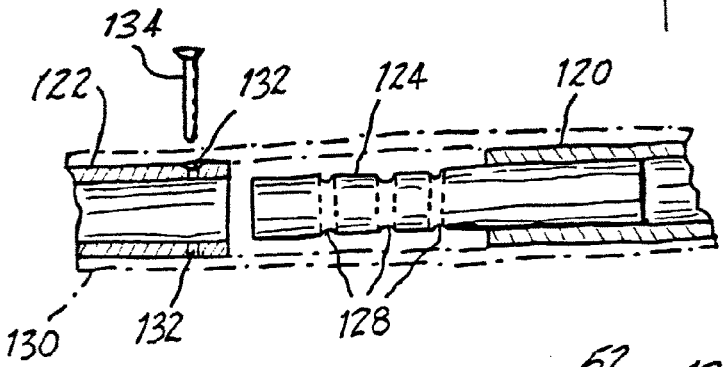
FIGS. 7 and 8 are enlarged fragmentary cross-sectional views of a portion of the boarding aid.
Figure 8:
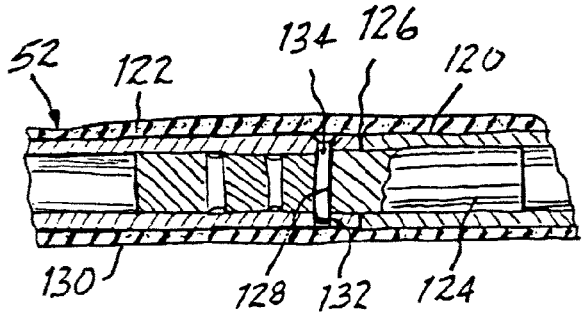

Initial installation of boarding aid 50 on an existing dinghy becomes a simple procedure, involving no special tools or special skills. Support members 80 are affixed readily to pontoon sides 32, as by an adhesive connection, placed at inboard locations 83 readily measured from transom 46. In order to accommodate dinghies of different beams B, handgrip bar 60 includes separate bar elements joined together selectively to establish any one of a plurality of selected lengths L between bar ends 61. In the preferred construction, separate pieces allow the length of the handgrip bar 60 between bar ends 61 to be selected so as to match the beam of a particular dinghy. Thus, as illustrated in FIGS. 7 and 8, viewed in connection with FIG. 3, handgrip bar 60 includes separate tubular elements 120 and 122. A central rod 124 is affixed within tubular element 120 and projects from tubular element 120 for telescopic engagement with tubular element 122 to establish a joint 126 between the tubular elements 120 and 122. A series of holes 128 pass through central rod 124 and are spaced apart along the length of central rod 124. In the illustrated arrangement, handgrip 52 is provided with a somewhat resilient grip material in the form of a sleeve 130 which is slipped over the joint 126 between the tubular elements 120 and 122. Inflatable dinghies are made available in standard sizes having different standard beams. The spacing between the holes 128 in the central rod 124 is chosen to correspond to the different beams, and tubular element 122 includes transverse apertures 132 capable of registration with any selected one of holes 128 to provide handgrip bar 60 with a length L corresponding to the beam of a particular dinghy 30. With sleeve 130 slipped away to expose tubular elements 120 and 122, tubular elements 120 and 122 are moved relative to one another to establish the selected length L, apertures 132 are registered with a selected hole 128, a pin 134 is inserted into apertures 132 and through selected hole 128 to lock in the selected length of handgrip bar 60. Sleeve 130 then is slipped back over joint 126. The sleeve 130 is provided with a length sufficient to overlie a joint 126 of any length which provides handgrip bar 60 with a selected length L, so that upon selection of a corresponding hole 128, any standard beam can be accommodated. Typically, length L will have a nominal length of about forty-two inches.

The curved configuration 138 at the lowermost end of each standard 64 assures that the support structure 62 always will be aligned for appropriate placement of the handgrip bar 60. That is, the support structure 62 is juxtaposed with pontoon sides 32, with the first end 66 of support structure 62 placed at the confronting inboard affixation locations 83 while a handgrip 52 is placed directly above a corresponding gunwale 48. In this manner, boarding aid 50 is rendered universal.

Figure 9:
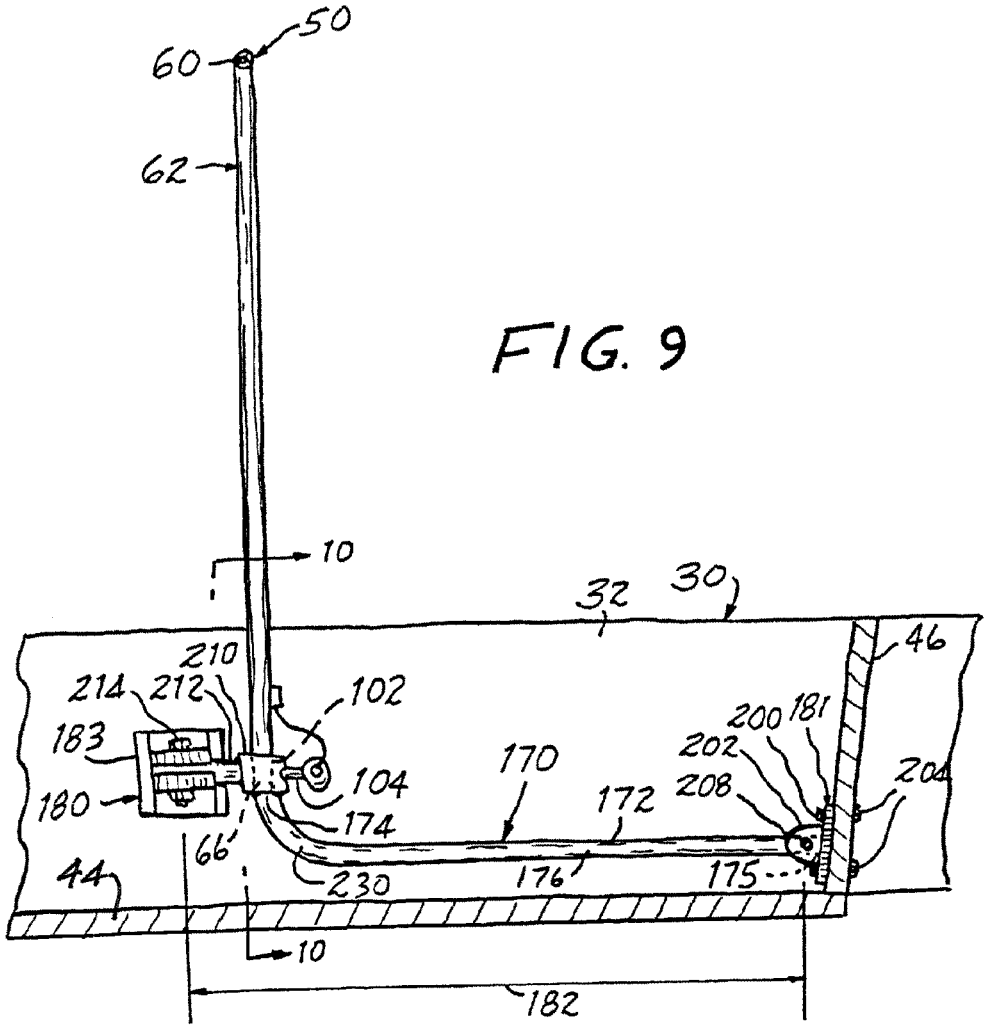
FIG. 9 is a fragmentary elevational view similar to FIG. 4, and showing another embodiment of the invention.
Figure 10:
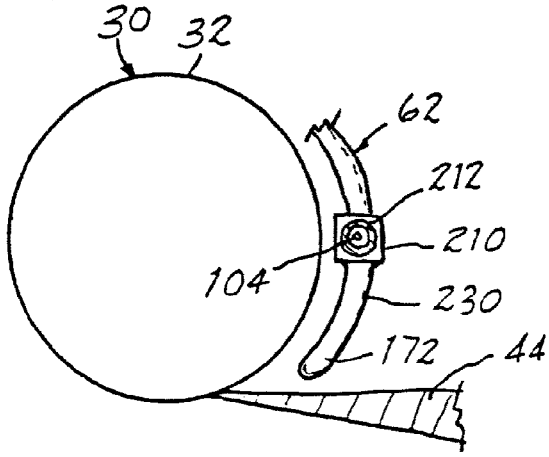
FIG. 10 is a cross-sectional view taken along line 10-10 of FIG. 9.

Referring now to FIGS. 9 and 10, in another embodiment of the present invention, support structure 62 is coupled at the first end to dinghy 30 with an alternate coupling arrangement which includes a pair of couplings 170 configured and dimensioned for affixation to pontoon sides 32 and to transom 46 of dinghy 30. Each coupling 170 includes a support rod 172 having a rod length between opposite rod ends 174 and 175, and a first attachment element at each rod end 174, 175. The support rod 172 preferably is in the form of a substantially rigid tubular member 176 having a first attachment element at each end 174 and 175. Each coupling 170 further includes a forward support member 180 and an aft support member 181, forward support member 180 being similar in construction to support member 80 described above, configured and dimensioned for affixation to a corresponding pontoon side 32, while aft support member 181 is configured and dimensioned for affixation to transom 46, with the forward support member 180 spaced from the transom 46 in a forward direction by a support distance 182. Forward support member 180 includes a base 183, preferably constructed of an elastomeric material, such as rubber, for conforming to the cross-sectional the configuration of the corresponding pontoon side 32. Each forward support member 180 is affixed to a pontoon side 32, as by an adhesive placed along base 183, so as to be permanently attached to the dinghy 30, at confronting inboard locations.

Aft support members 181 each include a base 200 and a pair of ears 202 integral with base 200. Each aft support member 181 preferably is constructed of a rigid material, such as a suitable metal or a synthetic polymeric material such as nylon or a polycarbonate, with ears 202 unitary with base 200. Through bolts 204 pass through each base 200 and through transom 46 to secure each aft support member 181 to transom 46. Rod end 175 is inserted between ears 202 such that ears 202 straddle the rod end 175, and a bolt 208 is passed through ears 202 and rod end 175 to secure the rod end 175 of each support rod 172 in place within an aft support member 181.

Each support rod 172 carries a coupling member at a coupling location adjacent the rod end 174, the coupling member being shown in the form of a socket 210 permanently secured to support rod 172, as by welding. A relatively short tubular stub shaft 212 is affixed to each socket 210, also as by welding, and projects forward from the socket 210 to engage and be secured within forward support member 180, utilizing a bolt 214, in a manner similar to that described above in connection with the engagement and securement of support rod 72 within support member 80. As described above, each standard 64 follows a curved configuration adjacent the first end 66 of support structure 62 and includes a coupling member in the form of a plug 102. socket 210 is provided with a configuration complementary to plug 102. Upon insertion of plug 102 into socket 210, support structure 62 is coupled with support rods 172 and boarding aid 50 is erected in dinghy 30, with handgrip 52 accessible for ready grasping by person 20. Each plug 102 is secured in place within a socket 210 by passing a locking pin 104 through respective registered apertures in plugs 102 and sockets 210. Each locking pin 104 is tethered to a standard 64 for convenience as well as for safety.

Forward support member 180 is spaced forward of aft support member 181, and forward of transom 46, by a distance which places the socket 210 at a generally amidships location. Consequently, the support structure 62, when coupled to support rods 172 at the coupling location provided by the position of the sockets 210, and the position of the support rods 172 with respect to the pontoon sides 32, places the handgrip 52 at the elevated position essentially amidships, and stability of the dinghy 30 is assured during the embarking and disembarking of a passenger, as exemplified in FIGS. 1 and 2 by person 20. At the same time, the coupling arrangement which includes support rods 172 secured to spaced apart support members 180 and 181 distributes the load associated with supporting the boarding or exiting person 20, thereby reducing the stress upon the pontoon sides 32 and on the transom 46 at each juncture between a support member 180, 181 and a corresponding pontoon side 32 or the transom 46, thereby better preserving the integrity of the pontoon sides 32 and the transom 46, and the respective connections to the dinghy 30. Moreover, the connection between each aft member 181 and the rigid support transom 46 reinforces and lends rigidity to the connection between the support structure 62 and the dinghy 30, while further and the decreasing stresses at the pontoon sides 32.

As best seen in FIG. 10, each support rod 172 preferably is extended downwardly from a respective socket 210 and is curved at 230 to follow the cross-sectional configuration of corresponding pontoon side 32 such that as support rod 172 extends in an aft direction to transom 46, support rod 172 remains closely adjacent pontoon side 32, near floor 44, so as to be unobtrusive and not be in the way of passengers.

When it is desired to stow the dinghy 30, support structure 62 is easily removed from the dinghy 30 by merely withdrawing locking pins 104 and pulling plugs 102 from corresponding sockets 210, thereby releasing support structure 62 and handgrip 52 from dinghy 30 for compact storage apart from dinghy 30. Should it become necessary to release support rods 172 from dinghy 30, as for maintenance or cleaning, it becomes a simple matter to remove bolts 208 and 214 to release support ends 174 from support members 180 and 181.

Figure 11:
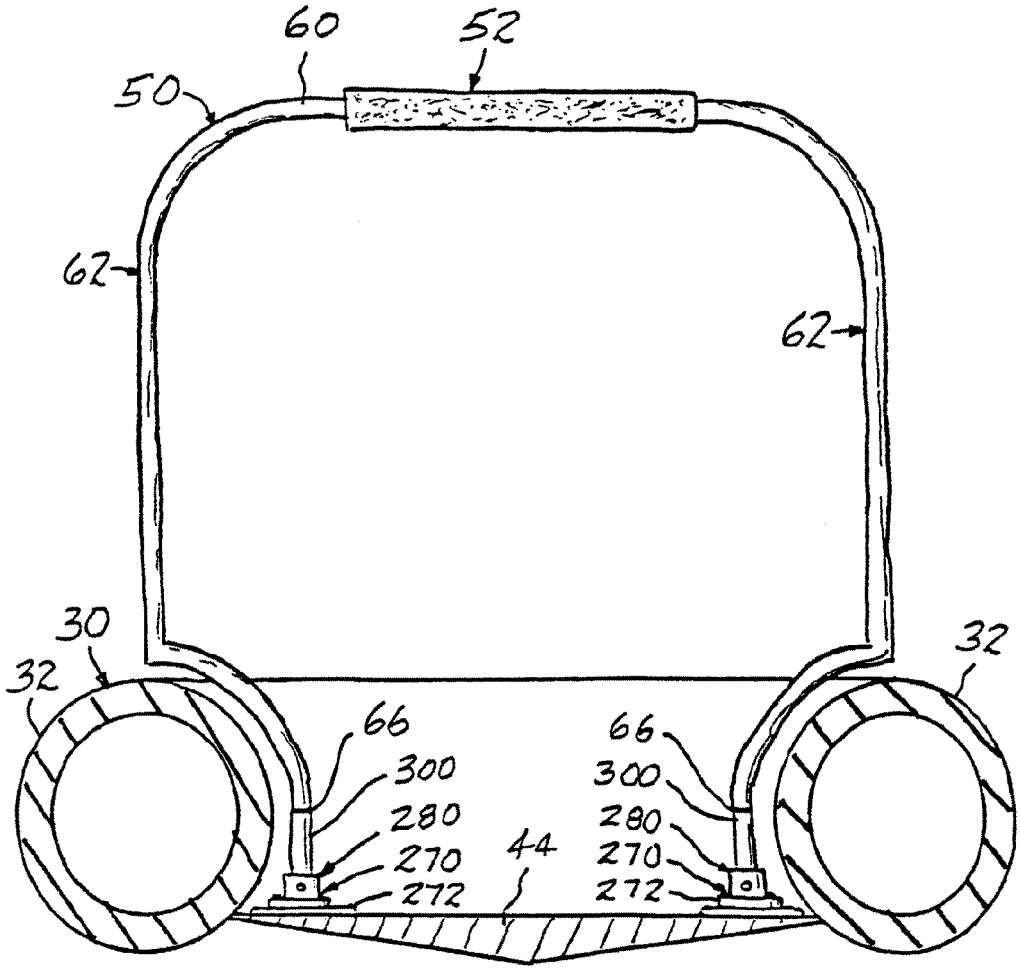
FIG. 11 is a partially diagrammatic, lateral cross-sectional view similar to FIG. 3, and showing still another embodiment of the invention.
Figure 12:
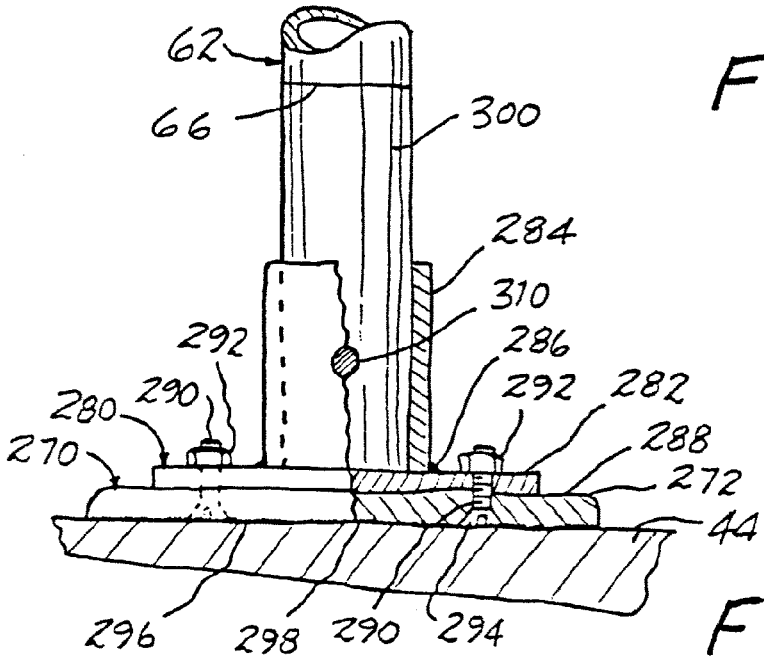
FIG. 12 is an enlarged, fragmentary view of a portion of FIG. 11.

Turning now to FIGS. 11 and 12, in still another embodiment of the present invention, support structure 62 is coupled at the first end 66 to dinghy 30 with an alternate coupling arrangement which includes a pair of couplings 270 configured and dimensioned for affixation to floor 44 of dinghy 30. Floor 44 is relatively rigid and is capable of providing affixation sites for effective support of support structure 62. However, in doing so, it becomes imperative to avoid puncturing floor 44 or otherwise disturbing the integrity of the floor 44. Thus, couplings 270 are constructed to take advantage of the rigidity of floor 44 without disturbing the integrity of floor 44.

Each coupling 270 includes a support pad 272 and a support member 280. Support member 280 includes a basal flange 282 and a coupling member in the form of a socket 284 integral with the basal flange 282 and extending upwardly from the basal flange 282. In the preferred construction, basal flange 282 and socket 284 are constructed of a suitable metal, such as stainless steel, and are joined together, as by welding at 286. Basal flange 282 is placed upon an upper support surface 288 of support pad 272 and is joined to support pad 272 by means of corrosion-resistant fasteners in the form of screws 290 which pass through basal flange 282 and through support pad 272, and lock nuts 292 which are threaded onto screws 290 and operate in concert with screw heads 294 to secure support member 280 to support pad 272.

Support pads 272 each include a lower basal surface 296 and are affixed permanently to floor 44, as with an adhesive, such as an epoxy, so as not to puncture or otherwise compromise the integrity of floor 44. To that end, lower basal surface 296 is provided with an affixation area 298 large enough to secure support pad 272 to floor 44 with sufficient strength to maintain support structure 62, and handgrip 52, in place during use of the boarding aid 50, without compromising the integrity of floor 44. Each screw head 294 is recessed within support pad 272 so as to avoid any deleterious contact with floor 44. Each support pad 272 is located so as to place a corresponding support member 280 closely adjacent a pontoon side 32, at a forward and aft position spaced forward of stern 42 and aft of bow 40, which places support members 280 essentially amidships. The lowermost end 66 of support structure 62 is provided with an extended plug 300 for selective engagement with socket 284 to connect support structure 62 to each support member 280, and a locking pin 310 is passed through registered holes in plug 300 and in socket 284. With plugs 300 seated within corresponding sockets 284, boarding aid 50 is erected for use as described above in connection with the embodiments illustrated in FIGS. 1 through 10.

When it is desired to stow the dinghy 30, support structure 62 is easily removed from the dinghy 30 by merely withdrawing locking pins 310 and pulling plugs 300 from corresponding sockets 284, thereby releasing support structure 62 and handgrip 52 from dinghy 30 for compact storage apart from dinghy 30. Should it become necessary to release support members 280 from dinghy 30, as for maintenance or cleaning, it becomes a simple matter to remove lock nuts 292 to release support members 280 from support pads 272.

Figure 13:
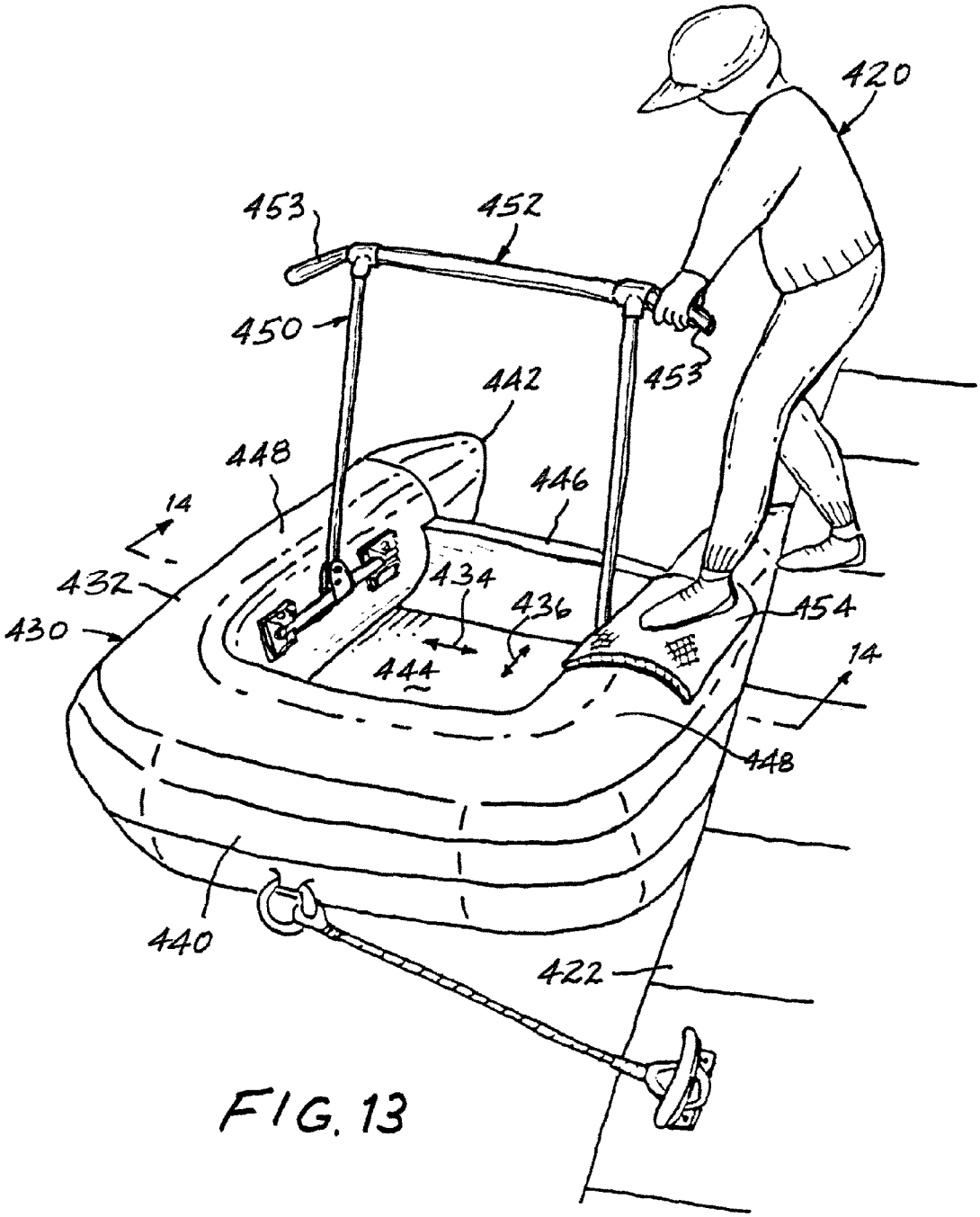
FIG. 13 is a pictorial view showing another boarding aid constructed in accordance with the present invention in use in an inflatable dinghy.

Referring now to FIG. 13, a person is shown at 420 stepping from a dock 422 to board and be seated in an inflatable dinghy 430 tied to the dock 422. Inflatable dinghy 30 is of conventional construction, having inflated pontoon sides 432 spaced apart in lateral directions 434 by an inboard distance 435 (see FIG. 14) and extending in forward and aft directions 436 between a bow 440 and a stern 442. A floor 444 extends laterally between the pontoon sides 432 and longitudinally in the forward and aft directions between the bow 440 and the stern 442. A transom 446 extends laterally between the pontoon sides 432, adjacent the stern 442, and the pontoon sides 432 extend altitudinally upward from the floor 444 to gunwales 448.

A boarding aid constructed in accordance with the present invention is shown at 450 and is installed in dinghy 430 to provide a handgrip bar 452 at an elevated position, handgrip bar 452 including a handgrip 453 at each end of the handgrip bar 452, the handgrips 453 being located a substantial altitudinal distance above the gunwales 448 and oriented in alignment with lateral directions 434 so as to be placed directly above the gunwales 448 for ready grasping by the person 420 while the person 420 remains in an essentially erect posture as the person steps aboard the dinghy 430, thereby enabling a sure-footed stance and promoting confidence during boarding, and during leaving dinghy 430. That is, as the person 420 steps from the dock 422 to the dinghy 430, as seen in FIG. 13, a handgrip 453 is available for ready grasping while the person 420 has a sure-footed purchase on the dock 422 and on the dinghy 430. Then, as the person 420 continues boarding and steps down into dinghy 430 handgrip bar 452 still is available for grasping, with two hands spread apart in lateral directions, to maintain confidence, stability and safety.

Throughout the boarding process, handgrip bar 452 is available to enable the person 20 to remain in the essentially erect posture, for a sure-footed stance providing confidence and safety. This is particularly true where the dinghy 430 is tied to a fixed dock 422 in tidal waters where the difference in elevation between the dinghy 430 and the dock 422 may be extensive and may vary with the tide. Further, the handgrip bar 452, together with handgrips 453, is placed at a forward distance from the transom 446 and at an aft distance from the bow 440 so as to maintain stability as the person 20 steps aboard and is seated within the dinghy 430, or rises to leave the dinghy 430, the forward distance and the aft distance preferably placing the handgrip bar 452 at an amidships location, that is, essentially midway between the stern 442 and the bow 440, spaced from both the bow 440 and the transom 446, to facilitate appropriate placement of the person 420 within the dinghy 430 upon boarding and to ease exit from the dinghy 430 upon leaving.

Preferably, a boarding mat 454 of a skid-resistant material is draped over the gunwale 448 which is adjacent dock 422, as shown, in order to enhance a sure-footed purchase as the person 420 steps upon the pontoon side 432. It is noted that the handgrips 453 extend in the lateral directions 434 well over the gunwales 448, the handgrip bar 452 extending essentially along the full width of the dinghy 430 so as to be available directly above the gunwales 448 for grasping without requiring the person 420 to reach over an excessive distance which otherwise could disturb the desired erect posture as the person 420 boards the dinghy 430, or leaves the dinghy 430.

Figure 14:
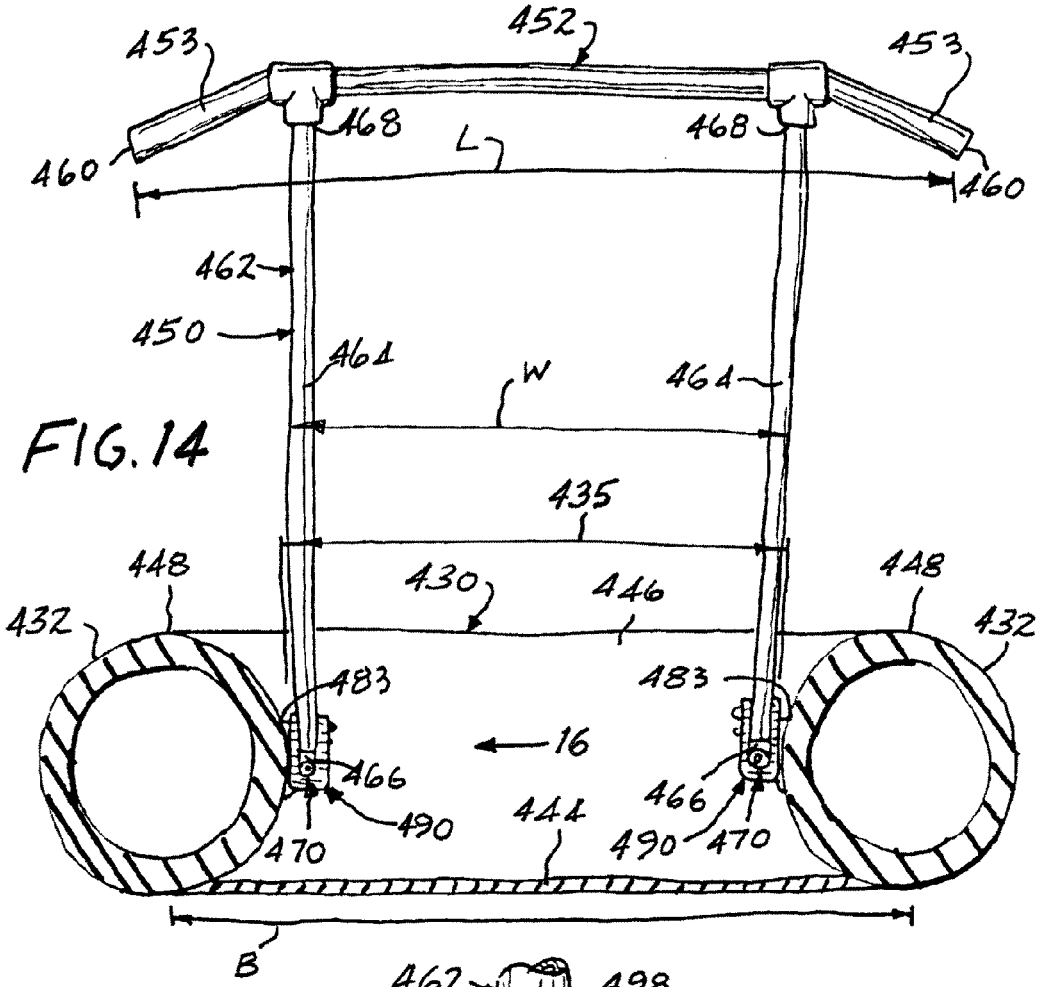
FIG. 14 is a partially diagrammatic, enlarged cross-sectional view taken along line 14-14 of FIG. 13.
Figure 15:
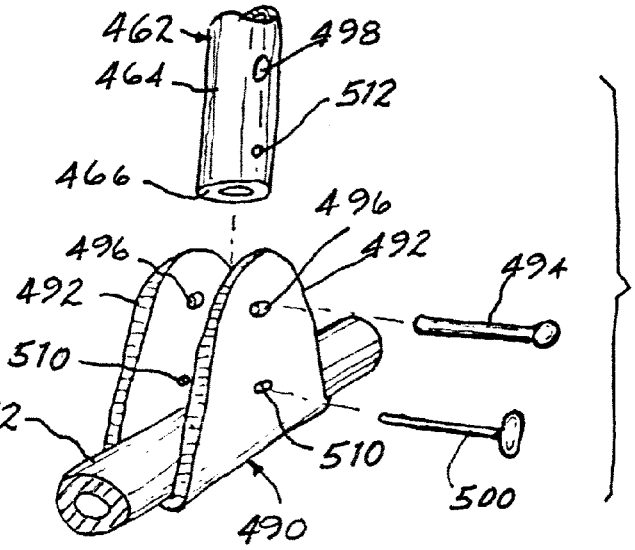
FIG. 15 is an exploded fragmentary pictorial view of component parts of the boarding aid of FIG. 13.
Figure 16:
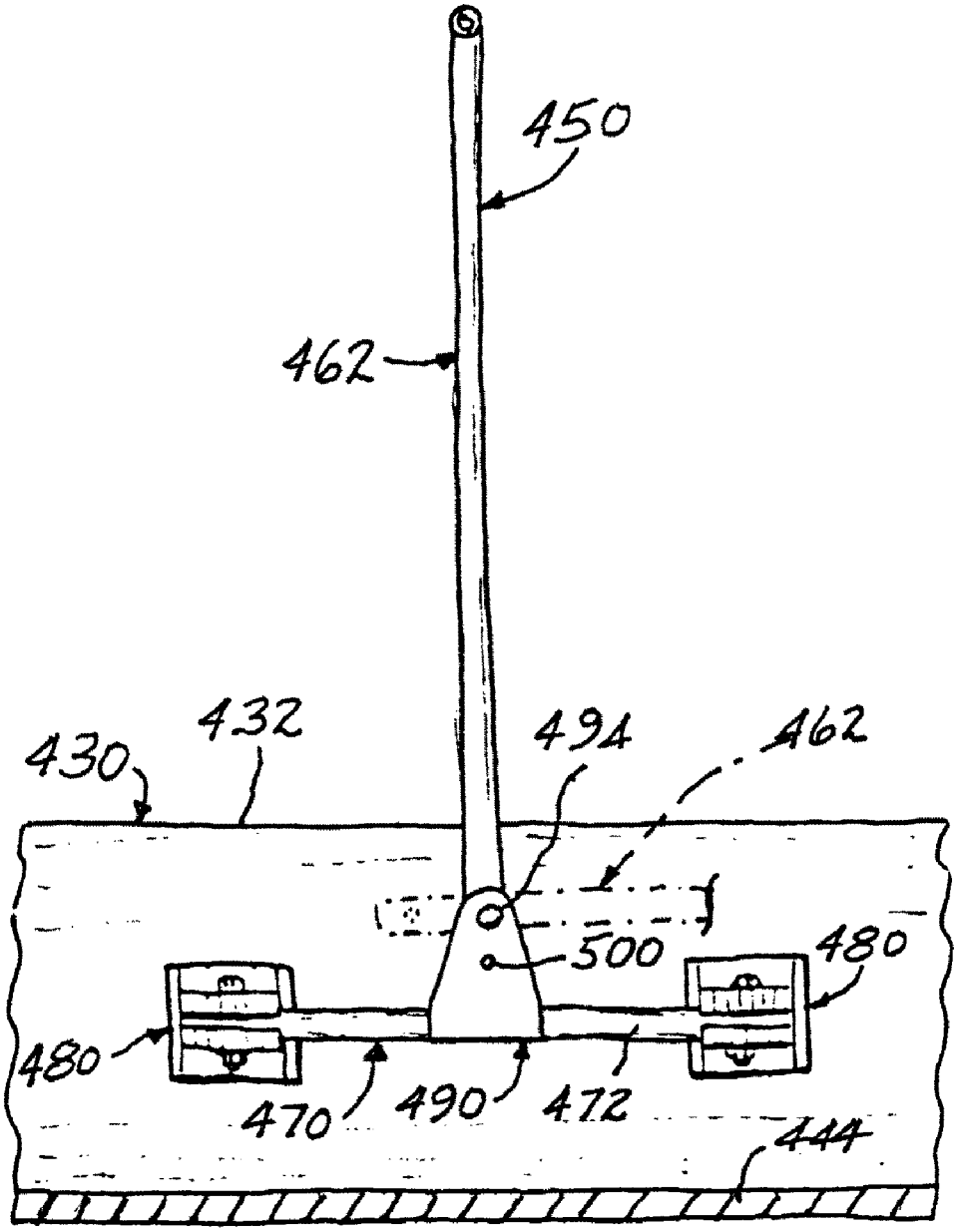
FIG. 16 is a fragmentary elevational view taken in the direction of arrow 16 in FIG. 14.

Turning now to FIGS. 14 through 16, as well as to FIG. 13, pontoon sides 432 are spaced apart by a predetermined lateral distance to provide dinghy 430 with a given beam B, as well as inboard distance 435, and handgrip bar 452 has a length L between opposite bar ends 460 substantially corresponding to the beam B of dinghy 430 so that, together with the lateral orientation of handgrip bar 452, the handgrips 453 are rendered readily accessible for grasping by the person 420, as illustrated in FIG. 13 and described above. To that end, handgrip bar 52 is supported by a support structure 462, here shown in the form of a pair of standards 464. Upon erection of the support structure 462, with each standard 464 depending from handgrip bar 452 adjacent a corresponding bar end 460, the support structure 462 has a prescribed longitudinal length between a first end 466 juxtaposed with the pontoon sides 432, adjacent the floor 444, and a second end 468 juxtaposed with the handgrip bar 452. The preferred configuration of support structure 462 places the standards 464 in juxtaposition with corresponding pontoon sides 432, spaced apart in lateral directions so as to enable unobstructed movement of a person 420 within the dinghy 430 during boarding and leaving the dinghy 430, as well as during traveling in the dinghy 430.

A coupling arrangement couples the first end 466 of the support structure 462 with the dinghy 430 and includes a pair of couplings 470, each coupling 470 including a support rod 472 affixed to a corresponding pontoon side 432 by a pair of support members 480, each support member 480 being configured and dimensioned for affixation to the corresponding pontoon side 432, as by an adhesive, so as to be permanently attached to the dinghy 430, at confronting inboard locations 483, all in a manner described more fully above.

As best seen in FIGS. 15 and 16, each support rod 472 carries a bracket 490 affixed to the support rod 472, as by welding or the like. Brackets 490 each include opposite ears 492 spaced apart so as to receive the first end 466 of a corresponding standard 464 in a sliding fit. A pivot pin 494 passes through bores 496 in ears 492 of each bracket 490 and extends through a hole 498 which passes through a corresponding standard 464 adjacent end 466 to establish a pivotal connection at each bracket 490, and a locking pin 500 passes through locking holes 510 in ears 492 to extend through a locking opening 512 in standard 464 to lock the standards 464, and the support structure 462, in the essentially vertical erect operating position illustrated in FIGS. 13 and 14, and in full lines in FIG. 16, and boarding aid 450 is erected in dinghy 430, with handgrips 453 accessible for ready grasping by person 420.

In order to place handgrips 453 at the desired elevated position, the prescribed length between first end 466 and second end 468 of support structure 462 is such that the handgrips 453 are placed at a substantial altitudinal distance above the gunwales 448, a typical altitudinal distance being about thirty inches.

When it is desired to stow the dinghy 430, support structure 462 is easily collapsed within the dinghy 430 by merely withdrawing locking pins 500 and pivoting the support structure 462 about pivot pins 494 into a collapsed position, as illustrated in phantom in FIG. 16, wherein the support structure 462 is folded for compact storage of dinghy 430. To that end, the lateral spacing between standards 464 provides support structure 462 with an overall width W (see FIG. 14) which is no greater than the inboard distance 435 so that upon movement of the support structure 462 into the collapsed position, the support structure 462 is placed unobtrusively between the pontoon sides 432, nested between the pontoon sides 432. When the support structure 462 is in the erect position, the handgrips 453 extend laterally well beyond width W so as to be accessible readily, as described above.

Figure 17:
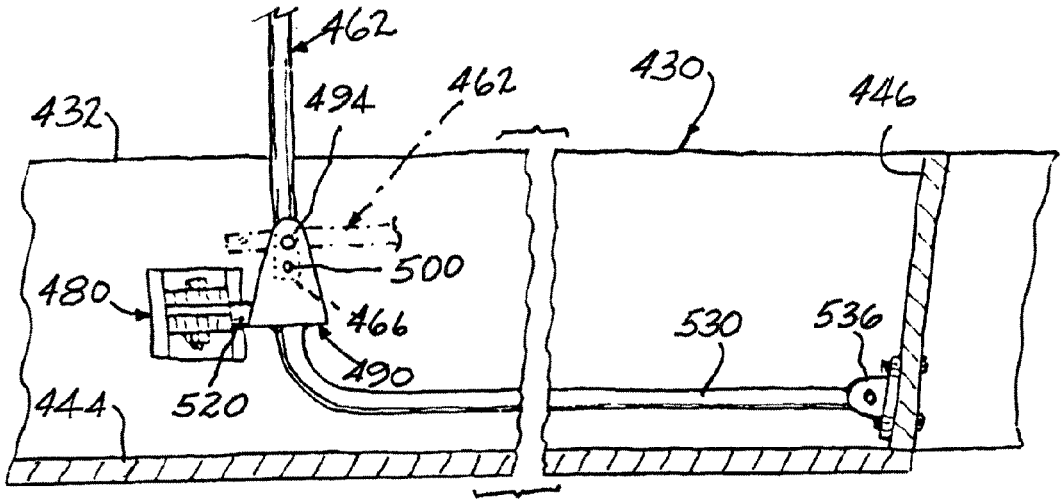
FIG. 17 is a fragmentary elevational view similar to FIG. 16 and showing still another embodiment of the invention.

Referring now to FIG. 17, in another embodiment of the present invention, support structure 462 is coupled at the first end 466 to dinghy 430 with a coupling arrangement which includes a single support member 480 affixed to each pontoon side 432, each support member 480 securing a stub shaft 520 to the corresponding pontoon side 432. The coupling arrangement further includes a bracket 490 affixed to each stub shaft 520, as by welding, and a rail 530 affixed to each bracket 90, again as by welding. Rail 530 extends in a longitudinal forward and aft direction to a remote end 532 which is secured to transom 446, as by a fitting 536. The extended length of rail 530 assures stability and distributes stresses to assure safety and reliability. As before, support structure 462 is locked by a locking pin 500 into the erect operating position, as shown in full lines, and is selectively folded into the collapsed position, shown in phantom, by removing locking pin 500 and rotating support structure 462 about pivot pin 494.

Figure 18:
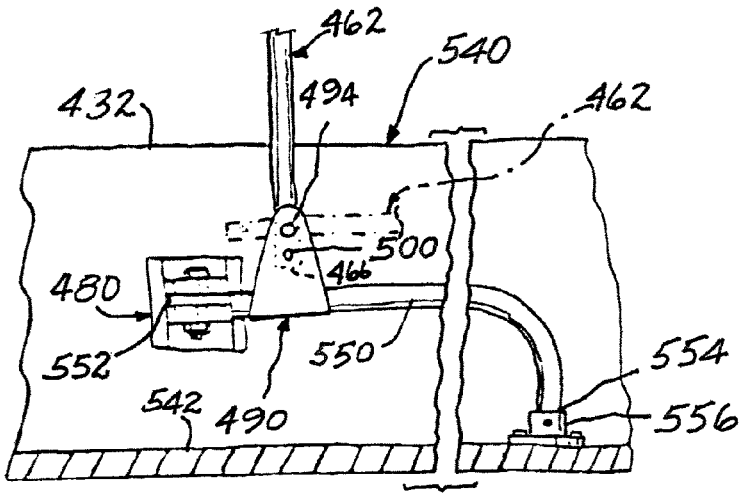
FIG. 18 is a fragmentary elevational view similar to FIG. 16 and showing yet another embodiment of the invention.

In the embodiment illustrated in FIG. 18, an inflatable dinghy 540 is constructed similar to dinghy 430 with the exception that dinghy 540 includes a rigid bottom 542. A support member 480 secures a rail 550 at one end 552 of the rail 550 to a corresponding pontoon side 432, while a remote end 554 is affixed to the rigid bottom 542, by a fitting 556. Again, the length of the rail 550 provides a high degree of stability, while distributing stresses for safety and reliability. A bracket 490 affixed to each rail 550, as by welding. As before, support structure 562 is locked by a locking pin 500 into the erect operating position, as shown in full lines, and is selectively folded into the collapsed position, shown in phantom, by removing locking pin 500 and rotating support structure 462 about pivot pin 494.

Figure 19:
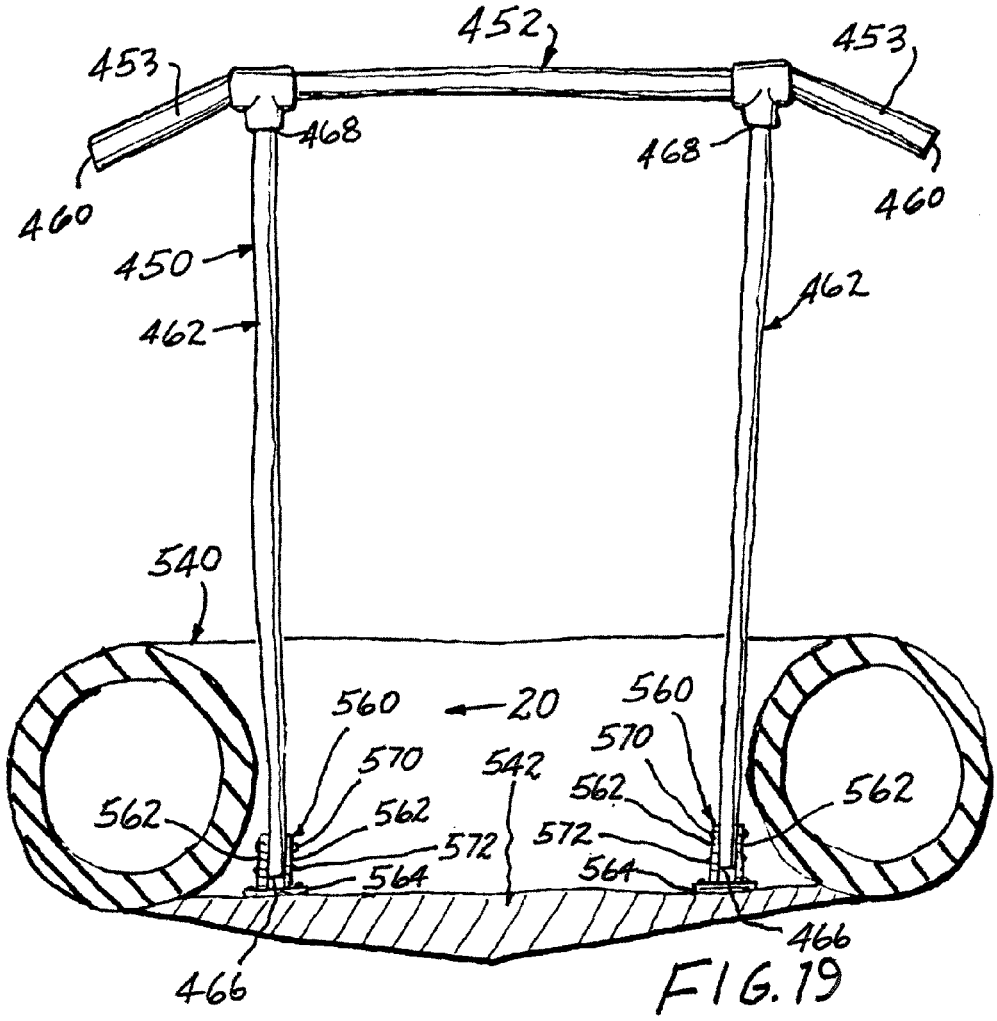
FIG. 19 is a partially diagrammatic, enlarged cross-sectional view similar to FIG. 14 and showing another embodiment of the invention.
Figure 20:
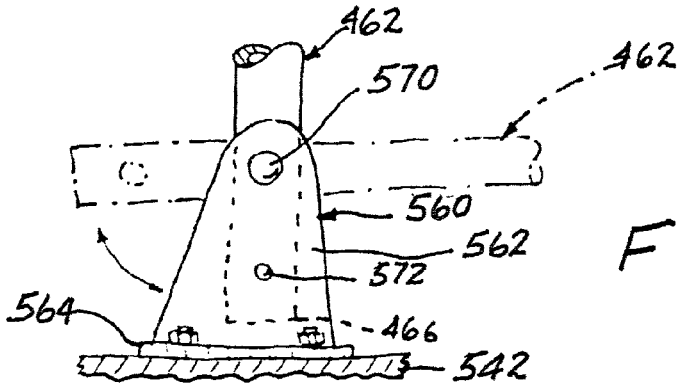
FIG. 20 is an enlarged fragmentary elevational view taken in the direction of arrow 20 in FIG. 19.

In the embodiment illustrated in FIGS. 19 and 20, wherein dinghy 540 includes rigid bottom 542, support structure 462 is connected directly to bottom 542 by means of brackets 560, each of which brackets 560 includes opposite ears 562 and a basal member 564. The basal member 564 is secured to the bottom 542 and, as before, the ends 466 of support structure 462 are mounted for pivotal movement about pivot pins 570 and locked into the erect operating position, shown in full lines, by locking pins 572. Upon selective removal of locking pins 572, the support structure 462 can be folded into the collapsed position, illustrated in phantom.

Figure 21:
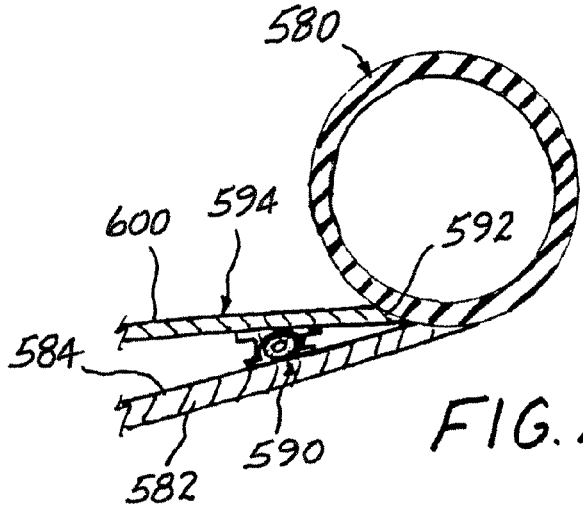
FIG. 21 is a fragmentary transverse cross-sectional view showing an adapter in place in connection with a particular inflatable dinghy.
Figure 22:
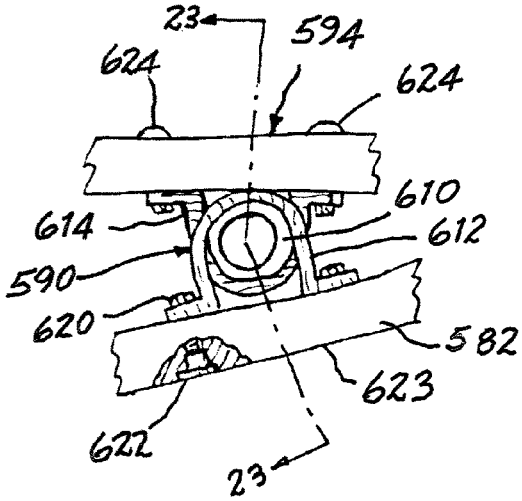
FIG. 22 is a largely diagrammatic fragmentary illustration, enlarged in size, showing the adapter of FIG. 21.
Figure 23:
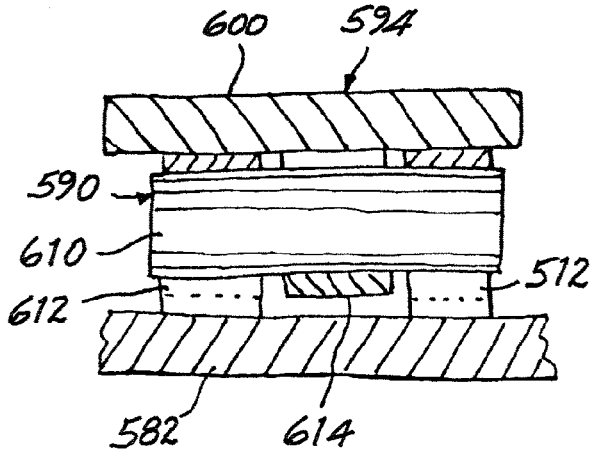
FIG. 23 is a cross-sectional view taken along line 23-23 of FIG. 22.

Turning now to FIGS. 21 through 23, where an inflatable dinghy 580 includes a rigid bottom 582 having an internal V-shaped floor configuration, as shown at 584, an adapter 590 enables the support structure 462 (not shown in FIGS. 21 through 23) to be mounted in the dinghy 580 in a manner similar to that described above in connection with dinghy 540. To that end, an adapter 590 is placed adjacent each end 592 of a rigid brace 594 to mount brace 594 in a horizontal orientation, extending across dinghy 580, to provide a horizontal platform 600 upon which support structure 462 can be mounted, utilizing the brackets 560 (not shown in FIGS. 21 through 23), as described above.

Each adapter 590 includes a tubular bar 610 secured to bottom 582 by a pair of spaced apart straps 612, and secured to brace 594 by a single strap 614 placed intermediate the spaced apart straps 612. The straps 612 are bolted to the bottom 582 by bolts 620 engaged with T-nuts 622 so as to preserve a flush bottom surface 623. Intermediate strap 614 is bolted to brace 594 by bolts 624. The three straps 612 and 614 compensate for any angle made by a V-shaped configuration encountered in the field and enables a stable and safe mounting of the support structure 462 to a dinghy having a V-shaped floor configuration.

It will be seen that the present invention attains all of the objects and advantages summarized above, namely: Provides a handgrip having extended dimensions and being placed in an inflatable dingy, located and oriented for convenient grasping to assist a person in boarding or leaving the dinghy; enables a passenger to embark upon or debark from an inflatable dinghy while maintaining a confident and sure-footed posture for reducing apprehension and increasing safety, especially where the dinghy is at various elevations with respect to a dock in tidal waters; maintains a high degree safety while a passenger boards or leaves an inflatable dinghy; allows quick and convenient attachment of a handgrip to an inflatable dinghy upon deployment of the dinghy, while enabling ease of detachment upon stowing of the dinghy; is unobtrusive during use of the dinghy and compact for ready storage when the dinghy is stowed; provides a highly stable and reliable attachment to an inflatable dinghy while protecting the dinghy from excessive stresses and concomitant damage at various points of attachment; adjusts readily to relevant dimensions of a particular inflatable dinghy for universal use; provides a relatively inexpensive construction, readily fitted to current inflatable dinghies of various dimensions for encouraging widespread adoption and use; is installed readily on an existing inflatable dinghy without requiring special tools or special skills; promotes boating safety and convenience for an enhanced boating experience over a wider audience of boaters; enables a reliable and effective coupling of a boarding aid to an inflatable dinghy, without adversely affecting existing component parts of the dinghy; provides a rugged construction, resistant to wear and corrosion, for exemplary performance over an extended service life.

It is to be understood that the above detailed description of preferred embodiments of invention is provided by way of example only. Various details of design and construction may be modified without departing from the true spirit and scope of the invention, as set forth in the appended claims.

The embodiments of the invention in which an exclusive property or privilege is claimed are defined as follows:

1. A boarding aid for assisting a person in embarking on and disembarking from a dinghy having inflatable pontoon sides spaced apart in lateral directions by a predetermined lateral distance and having inboard side portions providing opposite confronting inboard side locations spaced apart laterally by a predetermined inboard side distance, the pontoon sides extending in forward and aft directions between a bow and a stern, a floor extending laterally between the pontoon sides and longitudinally in forward and aft directions between the bow and the stern, and a transom extending between the pontoon sides adjacent the stern, each pontoon side extending altitudinally upward from a bottom to a gunwale located at a predetermined height above the floor, the boarding aid comprising:

a handgrip bar having a length extending between opposite bar portions;

a support structure having a first support portion for juxtaposition with the inboard side locations of both pontoon sides, and a second support portion spaced from the first support portion along a longitudinal direction, the support structure being joined with the handgrip bar adjacent the second support portion of the support structure such that the handgrip bar extends laterally with respect to the longitudinal direction of the support structure along a lateral distance substantially corresponding to the predetermined lateral distance between the pontoon sides; and a coupling arrangement for coupling the first support portion of the support structure with the dinghy at a corresponding coupling location spaced away from the bow in an aft direction and spaced away from the stern in a forward direction, the coupling arrangement including at least one pair of couplings, each coupling of the one pair of couplings including support members spaced apart in a forward and aft direction by a support distance, at least one of the support members being configured and dimensioned for affixation to a corresponding pontoon side, at an affixation position on the inboard side location of the corresponding pontoon side, with the affixation position placed altitudinally at least substantially midway between the bottom and the gunwale of the corresponding pontoon side, and another of the support members being configured and dimensioned for affixation to the dinghy at the corresponding coupling location;

the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions and placed at an elevated position located a substantial altitudinal distance directly above the gunwales, a forward distance from the transom, and an aft distance from the bow, so as to be accessible for ready grasping by a person remaining essentially erect as the person steps aboard or debarks from the dinghy.

2. The boarding aid of claim 1 wherein the forward distance and the aft distance place the elevated position at an amidships location essentially midway between the stern and the bow.

3. The boarding aid of claim 1 wherein the another of the support members is configured and dimensioned for affixation to a corresponding pontoon side, at another affixation position on the inboard side location of the corresponding pontoon side, with the another affixation position placed altitudinally at least substantially midway between the bottom and the gunwale of the corresponding pontoon side.

4. The boarding aid of claim 3 wherein each coupling includes a pivotal connection for selective movement of the support structure between an erect position, wherein the handgrip bar is placed at the elevated position, and a collapsed position, wherein the support structure is folded in juxtaposition with the pontoon sides for compact storage of the dinghy.

5. The boarding aid of claim 4 wherein the support structure is placed between the inboard side portions of the pontoon sides and extends in the forward and aft directions when in the collapsed position.

6. The boarding aid of claim 1 wherein the support structure includes a pair of standards spaced apart by a lateral distance substantially corresponding to the predetermined inboard side distance.

7. The boarding aid of claim 6 wherein the handgrip bar includes separate bar elements joined together selectively to establish any one of a plurality of selected lengths between the bar portions, each selected length being related to the predetermined lateral distance between the pontoon sides of a selected dinghy.

8. The boarding aid of claim 1 wherein the handgrip bar includes separate bar elements joined together selectively to establish any one of a plurality of selected lengths between the bar portions, each selected length being related to the predetermined lateral distance between the pontoon sides of a selected dinghy.

9. A boarding aid for assisting a person in embarking on and disembarking from a dinghy having inflatable pontoon sides spaced apart in lateral directions by a predetermined lateral distance and having inboard side portions providing opposite confronting inboard side locations spaced apart laterally by a predetermined inboard side distance, the pontoon sides extending in forward and aft directions between a bow and a stern, a floor extending laterally between the pontoon sides and longitudinally in forward and aft directions between the bow and the stern, and a transom extending between the pontoon sides adjacent the stern, each pontoon side extending altitudinally upward from a bottom to a gunwale located at a predetermined height above the floor, the boarding aid comprising:

a handgrip bar having a length extending between opposite bar portions;

a support structure having a first support portion for juxtaposition with the inboard side locations of both pontoon sides, and a second support portion spaced from the first support portion along a longitudinal direction, the support structure being joined with the handgrip bar adjacent the second support portion of the support structure such that the handgrip bar extends laterally with respect to the longitudinal direction of the support structure, along a lateral distance substantially corresponding to the predetermined lateral distance between the pontoon sides; and a coupling arrangement for coupling the first support portion of the support structure with the dinghy at a corresponding coupling location spaced away from the bow and stern in forward and aft directions, the coupling arrangement including at least one pair of couplings, each coupling of the one pair of couplings being configured and dimensioned for affixation to a corresponding pontoon side at the corresponding coupling location;

the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions and placed at an elevated position located a substantial altitudinal distance directly above the gunwales, a forward distance from the transom, and an aft distance from the bow, so as to be accessible for ready grasping by a person remaining essentially erect as the person steps aboard or debarks from the dinghy;

each coupling including:

a support rod having a rod length between opposite rod ends, and a first attachment element at each rod end;

a pair of support members, each support member being configured and dimensioned for affixation to a corresponding pontoon side, at an affixation position on the inboard side location of the corresponding pontoon side, with each affixtaion position placed altitudinally at least substantially midway between the bottom and the gunwale of the corresponding pontoon side, and with the pair of support members spaced apart in forward and aft directions by a support distance;

each support member having a second attachment element for engaging a corresponding first attachment element to secure the support rod to the corresponding pontoon side; and a coupling member on the support rod at a coupling location intermediate the rod ends for coupling the support structure to the support rod, such that the support distance and the coupling location promote stability during embarking and disembarking.

10. The boarding aid of claim 9 wherein the forward distance and the aft distance place the elevated position at an amidships location essentially midway between the stern and the bow, and the support members of each pair of support members include a first support member spaced from the amidships location in a forward direction and a second support member spaced from the amidships location in an aft direction, thereby further enhancing stability.

11. The boarding aid of claim 10 wherein the coupling arrangement includes a further coupling member carried by the support structure at the first support portion of the support structure, the further coupling member being complementary to the coupling member on the support rod for enabling the selective coupling and uncoupling of the support structure and the support rod such that upon selective uncoupling of the first support portion of the support structure from the couplings, the support structure and the handgrip bar will be released for stowing apart from the dinghy.

12. The boarding aid of claim 11 wherein each coupling includes a pivotal connection for selective movement of the support structure between an erect position, wherein the handgrip bar is placed at the elevated position, and a collapsed position, wherein the support structure is folded in juxtaposition with the pontoon sides for compact storage of the dinghy.

13. The boarding aid of claim 12 wherein the support structure is placed between the inboard side portions of the pontoon sides and extends in the forward and aft directions when in the collapsed position.

14. The boarding aid of claim 1 wherein the another of the support members is configured and dimensioned for affixation to the transom.

15. A boarding aid for assisting a person in embarking on and disembarking from a dinghy having inflatable pontoon sides spaced apart in lateral directions by a predetermined lateral distance and having inboard side portions providing confronting inboard side locations spaced apart laterally by a predetermined inboard distance, the pontoon sides extending in forward and aft directions between a bow and a stern, a floor extending laterally between the pontoon sides and longitudinally in forward and aft directions between the bow and the stern, and a transom extending between the pontoon sides adjacent the stern, each pontoon side extending attitudinally upward from a bottom to a gunwale located at a predetermined height above the floor, the boarding aid comprising:

a handgrip bar having a length extending between opposite bar portions;

a support structure having a first support portion for juxtaposition with the inboard side locations of both pontoon sides, and a second support portion spaced from the first support portion along a longitudinal direction, the support structure being joined with the handgrip bar adjacent the second support portion of the support structure such that the handgrip bar extends laterally with respect to the longitudinal direction of the support structure along a lateral distance substantially corresponding to the predetermined lateral distance between the pontoon sides; and a coupling arrangement for coupling the first support portion of the support structure with the dinghy at a corresponding coupling location spaced away from the bow and stern in forward and aft directions, the coupling arrangement including at least one pair of couplings, each coupling of the one pair of couplings being configured and dimensioned for affixation to a corresponding pontoon side and to the transom at the corresponding coupling location;

the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions and placed at an elevated position located a substantial altitudinal distance above the gunwales, a forward distance from the transom, and an aft distance from the bow, so as to be accessible for ready grasping by a person remaining essentially erect as the person steps aboard or debarks from the dinghy;

each coupling including:

a support rod having a rod length between opposite rod ends, and a first attachment element at each rod end;

a pair of support members, one support member of the pair of support members being configured and dimensioned for affixation to a corresponding pontoon side at an inboard side location on the corresponding pontoon side placed altitudinnally at least substantially midway between the bottom and the gunwale of the corresponding pontoon side, and another of the pair of support members being configured and dimensioned for affixation to the transom, with the pair of support members spaced apart in forward and aft directions by a support distance;

each support member having a second attachment element for engaging a corresponding first attachment element to secure the support rod to the corresponding pontoon side and to the transom; and a coupling member on the support rod at a coupling location spaced away from the transom in a forward direction for coupling the support structure to the support rod, such that the support distance and the coupling location promote stability during embarking and disembarking.

16. The boarding aid of claim 15 wherein the forward distance and the aft distance place the elevated position at an amidships location essentially midway between the stern and the bow, and the one support member of each pair of support members is located adjacent the amidships location, thereby further enhancing stability.

17. The boarding aid of claim 16 wherein the coupling location is placed on the support rod adjacent the one support member.

18. The boarding aid of claim 17 wherein the coupling arrangement includes a further coupling member carried by the support structure at the first support portion of the support structure, the further coupling member being complementary to the coupling member on the support rod for enabling selective coupling and uncoupling of the support structure and the support rod such that upon selective uncoupling of the first support portion of the support structure from the couplings, the support structure and the handgrip bar will be released for stowing apart from the dinghy.

19. The boarding aid of claim 17 wherein each coupling includes a pivotal connection for selective movement of the support structure between an erect position, wherein the handgrip bar is placed at the elevated position, and a collapsed position, wherein the support structure is folded in juxtaposition with the pontoon sides for compact storage of the dinghy.

20. The boarding aid of claim 19 wherein the support structure is placed between the inboard side portions of the pontoon sides and extend in the forward and aft directions when in the collapsed position.

21. A boarding aid for assisting a person in embarking on and disembarking from a dinghy having inflatable pontoon sides spaced apart in lateral directions by a predetermined lateral distance and having inboard side portions providing confronting inboard side locations spaced apart laterally by a predetermined lateral distance, the pontoon sides extending in forward and aft directions between a bow and a stern, a floor extending laterally between the pontoon sides and longitudinally in forward and aft directions between the bow and the stern, and a transom extending between the pontoon sides adjacent the stern, the pontoon sides extending altitudinally upward from the floor to corresponding gunwales located at a predetermined height above the floor, the boarding aid comprising:

a handgrip bar having a length extending between opposite bar portions, the length of the handgrip bar corresponding substantially to the predetermined lateral distance between the pontoon sides;

a support structure having a first support portion for juxtaposition with the inboard locations of both pontoon sides, and a second support portion spaced from the first support portion along a longitudinal direction, the support structure being joined with the handgrip bar adjacent the second support portion of the support structure such that the handgrip bar extends laterally with respect to the longitudinal direction of the support structure along a lateral distance substantially corresponding to the predetermined lateral distance between the pontoon sides; and a coupling arrangement for coupling the first support portion of the support structure with the dinghy at a corresponding coupling location spaced away from the bow and stern in forward and aft directions, the coupling arrangement including at least one pair of couplings, each coupling of the one pair of couplings being configured and dimensioned for affixation to the floor adjacent the inboard side portion of a corresponding pontoon side at the corresponding coupling location;

the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions, along substantially the entire predetermined lateral distance between the pontoon sides, and the opposite bar portions placed at an elevated position located a substantial altitudinal distance directly above the gunwales, at a forward distance from the transom, and an aft distance from the bow, so as to be accessible for ready grasping by a person remaining essentially erect as the person steps upon a pontoon side in juxtaposition with a corresponding gunwale to board or debark from the dinghy.

22. The boarding aid of claim 21 wherein each coupling includes a pivotal connection for selective movement of the support structure between an erect position, wherein the handgrip bar is placed at the elevated position, and a collapsed position, wherein the support structure is folded in juxtaposition with the pontoon sides for compact storage of the dinghy.

23. The boarding aid of claim 22 wherein the support structure is placed between the inboard side portions of the pontoon sides and extends in the forward and aft directions when in the collapsed position.

24. A boarding aid for assisting a person in embarking on and disembarking from a dinghy having inflatable pontoon sides spaced apart in lateral directions by a predetermined lateral distance and having inboard side portions providing confronting inboard side locations spaced apart laterally by a predetermined side inboard distance, the pontoon sides extending in forward and aft directions between a bow and a stern, a floor extending laterally between the pontoon sides and longitudinally in forward and aft directions between the bow and the stern, and a transom extending between the pontoon sides adjacent the stern, the pontoon sides extending altitudinally upward from the floor to corresponding gunwales located at a predetermined height above the floor, the boarding aid comprising:

a handgrip bar having a length extending between opposite bar portions;

a support structure having a first support portion for juxtaposition with the inboard side locations of both pontoon sides, and a second support portion spaced from the first support portion along a longitudinal direction, the support structure being joined with the handgrip bar adjacent the second support portion of the support structure such that the handgrip bar extends laterally with respect to the longitudinal direction of the support structure along a lateral distance substantially corresponding to the predetermined lateral distance between the pontoon sides; and a coupling arrangement for coupling the first support portion of the support structure with the dinghy at a corresponding coupling location spaced away from the bow and stern in forward and aft directions, the coupling arrangement including at least one pair of couplings, each coupling of the one pair of couplings being configured and dimensioned for affixation to the floor adjacent an inboard side portion of a corresponding pontoon side at the corresponding coupling location;

the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions and placed at an elevated position located a substantial altitudinal distance directly above the gunwales, a forward distance from the transom, and an aft distance from the bow, so as to be accessible for ready grasping by a person remaining essentially erect as the person steps aboard or debarks from the dinghy;

each coupling including:

a support pad having a lower basal surface with an affixation area for being juxtaposed with the floor at an affixation site, and an upper support surface; and a coupling member on the support pad, the coupling member being placed on the upper support surface of the support pad and secured to the support pad;

the affixation area being sufficient to secure the support pad to the floor at the affixation site without compromising the integrity of the floor, so as to place the coupling member at the coupling location for coupling the support structure to the support pad such that the support structure and the coupling location provide stability during embarking and disembarking.

25. The boarding aid of claim 24 wherein the forward distance and the aft distance place the elevated position at an amidships location essentially midway between the stern and the bow.

26. The boarding aid of claim 25 wherein the coupling arrangement includes a further coupling member carried by the support structure at the first support portion of the support structure, the further coupling member being complementary to the coupling member on the support pad for enabling selective coupling and uncoupling of the support structure and the support pad such that upon selective uncoupling of the first support portion of the support structure from the couplings, the support structure and the handgrip bar will be released for stowing apart from the dinghy.

27. The boarding aid of claim 25 wherein each coupling includes a pivotal connection for selective movement of the support structure between an erect position, wherein the handgrip bar is placed at the elevated position, and a collapsed position, wherein the support structure is folded in juxtaposition with the pontoon sides for compact storage of the dinghy.

28. The boarding aid of claim 27 wherein the support structure is placed between the inboard side portions of the pontoon sides and extends in the forward and aft directions when in the collapsed position.

* * * * *